US009351561B2

(12) United States Patent
McCarthy

(10) Patent No.: US 9,351,561 B2
(45) **Date of Patent: *May 31, 2016**

(54) BRUSH APPARATUS

(71) Applicant: Michael McCarthy, Chelsea, MA (US)

(72) Inventor: Michael McCarthy, Chelsea, MA (US)

( * ) Notice: Subject to any disclaimer, the term of this patent is extended or adjusted under 35 U.S.C. 154(b) by 434 days.

This patent is subject to a terminal disclaimer.

(21) Appl. No.: 13/905,762

(22) Filed: May 30, 2013

(65) Prior Publication Data

US 2013/0333131 A1 Dec. 19, 2013

Related U.S. Application Data

(60) Provisional application No. 61/659,526, filed on Jun. 14, 2012.

(51) Int. Cl.

| | |
|---|---|
| ***A46B 15/00*** | (2006.01) |
| ***A46B 3/12*** | (2006.01) |
| ***A46B 17/02*** | (2006.01) |

(52) U.S. Cl.

CPC ..... *A46B 15/0095* (2013.01); *A46B 3/12* (2013.01); *A46B 17/02* (2013.01); *A46B 2200/202* (2013.01)

(58) Field of Classification Search

CPC ..... A46B 15/0095; A46B 3/12; A46B 17/02; A46B 2200/202; A46B 5/00; A46B 7/04

See application file for complete search history.

(56) References Cited

U.S. PATENT DOCUMENTS

| | | | | | |
|---|---|---|---|---|---|
| 3,432,875 | A * | 3/1969 | Edelson | B44D 3/123 | 15/246 |
| 3,536,285 | A * | 10/1970 | Vaughn | B44D 3/123 | 211/65 |
| 3,729,158 | A * | 4/1973 | Nagy | B44D 3/123 | 248/110 |
| 2005/0156085 | A1 * | 7/2005 | Radovan | A46B 17/02 | 248/110 |

* cited by examiner

*Primary Examiner* — Robert Scruggs
(74) *Attorney, Agent, or Firm* — Bay State IP, LLC

(57) ABSTRACT

A multipurpose brush mechanism featuring an attachment and retainer mechanism to provide ease of use and effective storage for professional painters and consumers alike. The attachment mechanism includes an embedded hook which may be removably attached and may utilize numerous clip mechanisms and magnetic attraction members. The brush functions as an ordinary paint brush but the magnetic attachments allow it hang inside a paint can, or on any other accessory. The multifunctional hook can also allow for easy storage when the project is completed.

17 Claims, 7 Drawing Sheets

BRUSH APPARATUS

CROSS REFERENCE TO RELATED APPLICATION

This application claims the benefit of and takes priority from U.S. Patent Application Ser. No. 61,659,526 filed on Jun. 14, 2012, the contents of which are hereby incorporated by reference.

BACKGROUND OF THE INVENTION

1. Field of the System

The present system pertains to hardware apparatuses and more specifically to viscous fluid application brushes with embedded attachment mechanisms for use in restraining the viscous fluid application brushes within or outside a container or in various other areas in order to provide the user with convenience and ease of use.

2. Description of Concurrent Art

In everyday usage, a brush comprises a handheld tool used to apply paint or sealers to paintable surfaces. Brushes are designed to pick up paint with filament, and often include a ferrule, which may consist of a metal band that holds the filament and handle together and gives the brush strength, a spacer plug within the ferrule which helps the filament sits tightly in the brush and creates a reservoir for designed maters for application such as paint, varnish and the like, epoxy to lock the filament, and a handle which provides comfort and good balance. The brush industry categorizes their products based on the user of the product. Thus, there are consumer grade paintbrushes made for the homeowner who is painting small projects, professional grade paintbrushes for the professional house painter who requires a high-quality, long-lasting brush, and artistic grade paintbrushes.

Like most products of manufacture, brushes vary tremendously based on the quality of components used and are specifically constructed for the application of different genres of paint, varnishes, lacquer and other like substances, as a function of the surface to be applied upon. The filament may be either animal bristle or synthetic and the brush quality largely rests on the differences in these materials. Inexpensive animal hair brushes used in lower grade brushes are of unbleached hog bristle, however, the most expensive animal hair brushes are of sable and are used for delicate hand painting. These synthetics vary greatly in quality and may be used for cheap brushes as well as better-quality brushes. Handles are of wood or plastic; the rounder the brush the easier it is to manipulate the brush for intricate movement.

Most brushes are manufactured in a factory. However, the more expensive professional quality brushes may still be produced in a factory but may be assembled, at least in part, by hand-assembly methods. Those who require delicate brushes for fine oil or watercolor painting may make their own brushes or purchase them from a specialist who produces them to order. These handmade brushes can be very expensive.

Paintbrushes, namely wooden or polymer handled and bristled brushes, have long been used in the paint industry to assist professionals and consumers with high quality paint jobs. These brushes have historically needed additional accessories including a resting spot for the brush during projects and containers to store the brush after projects. Leaving a brush can lead to problems including: making the surface dirty, contaminating the brush with dirt or residue from the surface, wasting paint, and the brush becoming stuck to the surface. When budgets are large perhaps having numerous disposable accessories or merely throwing brushes away from project to project is feasible. However, the average consumer does not have a large budget and most professional prefer to keep the supply overhead low.

Concurrent systems have featured accessories that allow the paintbrush to adhere directly to the paint containment vessel by utilizing strapping and even attractive material. However such systems suffer from direct contact with containment vessel as the containment apparatuses may tend to tip and spill as the vector of release of brush from the containment vessel will tend to topple the vessel as fluid is decreased.

Furthermore, systems utilizing a strap, which comprises a removable apparatus and thus involved additional expense, storage and travel issues. Additionally, accessories are more likely to be lost due to the inherent disassociated nature of separate tools and the normally transient nature of artisans as they travel from job to job.

One of the greatest challenges a professional painter or consumer faces in completing a paint project is cutting in or using a tapered or otherwise angular brush to paint corners, seams, and edges. Painting by nature is a predominately standing task and the typical paint can sold at retail outlets is a minimum of a gallon. A painter therefore must be able to access their brush and paint from a height at least as tall as the average room ceiling but for professional sometimes much greater. This usually involves the use of a ladder or stool and it is necessary that the painter be able to safely and easily maneuver all of the tools involved.

Concurrent art has attempted to solve this problem but creating accessories that clip on, stick on or otherwise attach to the paint can and then the paintbrush adheres to them. The issue with these designs is the need for a professional or consumer to adhere these items in advance and be prepared. There is therefore still a need for an easy and quick adhesion method that does not require the use of additional materials.

Likewise, the concurrent arts only allows for the brush to be positioned on the inside of the can so if the paint can is currently greater than half full the brush will be submerged in paint. This causes the handle to get paint on it and can lead to a greater mess and headache for the user. There is therefore also a need for a paintbrush that can adhere on either the inside during the paint project or on the outside when the project is just beginning.

Another challenge that painter face is the mess painting can cause. Professionals can lose money over paint drips on costumers' property and consumers are possibly even more likely to have drips and spills due to their lack of knowledge and skill Concurrent arts do allow for the paintbrush to sit inside the paint can allowing drips to stay contained. However, once the project is completed concurrent art requires the release of an accessory. Such release with a paint laden brush can cause splatter. Concurrent arts that allow the paintbrush to be removed first and then the accessory to be removed may tend to have less splatter, but during the paint project these brushes are continually removed from their accessory and could cause splatter. Furthermore, reaching into the can to remove the brush may lead to overturning a can and causing a significant mess.

Finally paint products generally tend to have a high cost and since there is a need for specialized tools, a painter is faced with a requisite amount of devices and therefore the need to store said tools and to be able to access these tools during a procedure is highly important. Consumers can be overwhelmed with the saturation of the paint market, so there is a need for devices that serve multiple functions and can save not only on cost, but confusion and space as well. Likewise most users do not throw brushes away after a project especially if the brush was able to resist damage. Therefore there is a need to store the brush until the next project. Most consumers may use baggies or boxes and professional may invest in sturdier tool boxes and paint buckets, but piling paintbrushes into a container with numerous other tools can lead to bends and ultimately ruin the paintbrush. Therefore there is a need for a paintbrush that can easily be hung up after use cuts down on space concerns and possible damage.

SUMMARY OF THE INVENTION

The instant apparatus and system, as illustrated herein, is clearly not anticipated, rendered obvious, or even present in any of the prior art mechanisms, either alone or in any combination thereof. A versatile system, method and series of apparatuses for creating and utilizing a self retaining fluid application brush mechanism and included retaining and stowage system and apparatus. Thus the several embodiments of the instant apparatus are illustrated herein.

In its broadest interpretation, this disclosure describes the methods and systems for the self-retaining and stowage fluid application brush mechanism, a primary goal of which is to provide paintbrush that comprises a magnetic hook that will overcome the shortcomings of the concurrent art fluid application brushes, including but not limited to oil brushes, lacquer brushes, paintbrushes and paintbrush accessories. It is yet another object of the present system to provide a paintbrush that comprises a magnetic hook to allow the user to securely attach the brush to paint buckets and other items.

It is yet another object of the present system to provide a paintbrush that comprises a magnetic hook that allows user to securely and effectively store the paintbrush and another object of the present system is to provide paintbrush that comprises a magnetic hook which is cost effective and limits the amount of additional accessories needed to complete a paint project.

It is still another object of the present system to provide a tool that limits the amount of time a paint job takes due to its ease of use and capable functionality thus limiting the potential for mess and improving user comfort.

Briefly stated, in one embodiment, the present system contemplates a paintbrush that comprises a magnetic hook to securely adhere a paintbrush to a paint can or other item during a paint job and then to easily be able to store the brush after completion the paintbrush featuring: a wooden handle, a bristled brush, and a magnetic disc adhered to the wooden handle, wherein the magnet may attach to various clipping mechanisms including a hook.

The paintbrush that comprises a magnetic hook of the present system is adapted to be used with any standard paint can or various other items. The present system claims a paintbrush that is easily attached by hanging the brush on the lip of the paint can.

To the accomplishment of the foregoing and related ends, certain illustrative aspects are described herein in connection with the following description and the annexed drawings. These aspects are indicative of the various ways in which the principles disclosed herein can be practice and all aspects and equivalents thereof are intended to be within the scope of the claimed subject matter. Other advantages and novel features will become apparent from the following detailed description when considered in conjunction with the drawings.

The configuration of the present system provides the paint professional or consumer with ease of access and security during the completion of a paint job by keeping the brush close, reducing mess, and not requiring the use of additional accessories. The paint brush can be used with the standard hook attachment or other attachments by easy magnetic removal.

There has thus been outlined, rather broadly, the more important features of the versatile tray table embodiments in order that the detailed description thereof that follows may be better understood, and in order that the present contribution to the art may be better appreciated. There are additional features of the system that will be described hereinafter and which will form the subject matter of the claims appended hereto.

In this respect, before explaining at least one embodiment of the system in detail, it is to be understood that the system is not limited in its application to the details of construction and to the arrangements of the components set forth in the following description or illustrated in the drawings. The system is capable of other embodiments and of being practiced and carried out in various ways. Also, it is to be understood that the phraseology and terminology employed herein are for the purpose of description and should not be regarded as limiting.

These together with other objects of the system, along with the various features of novelty, which characterize the system, are pointed out with particularity in the claims annexed to and forming a part of this disclosure. For a better understanding of the system, its operating advantages and the specific objects attained by its uses, reference should be made to the accompanying drawings and descriptive matter in which there are illustrated preferred embodiments of the system.

The foregoing has outlined the more pertinent and important features of the present system in order that the detailed description of the system that follows may be better understood, and the present contributions to the art may be more fully appreciated. It is of course not possible to describe every conceivable combination of components and/or methodologies, but one of ordinary skill in the art may recognize that many further combinations or permutations are possible. Accordingly, the novel architecture described below is intended to embrace all such alterations, modifications, and variations that fall within the spirit and scope of the appended claims.

BRIEF DESCRIPTION OF THE DRAWING FIGURES

Advantages of the present system will be apparent from the following detailed description of exemplary embodiments thereof, which description should be considered in conjunction with the accompanying drawings, in which: Having thus described the system in general terms, reference will now be made to the accompanying drawings, which are not necessarily drawn to scale, and wherein.

DETAILED DESCRIPTION OF THE DISCLOSURE

The detailed description set forth below in connection with the appended drawings is intended as a description of presently preferred embodiments of the system and does not represent the only forms in which the present system may be constructed and/or utilized. The description sets forth the functions and the sequence of steps for constructing and operating the system in connection with the illustrated embodiments.

Figure 1:
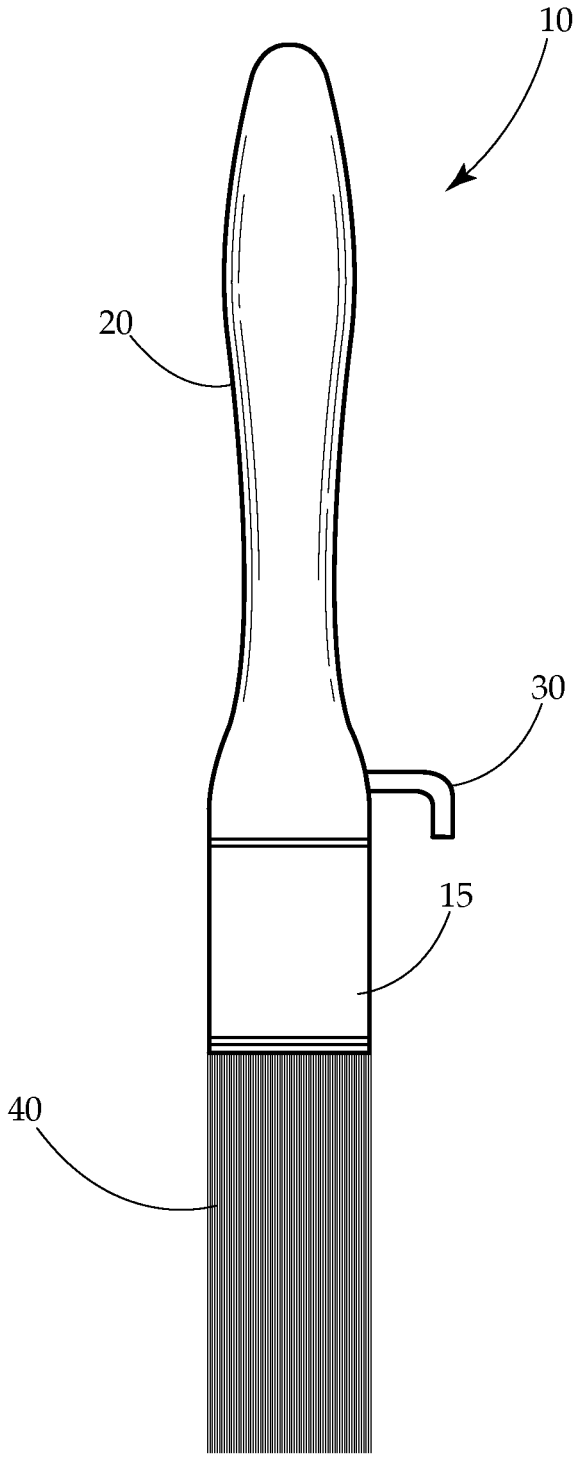
FIG. 1 shows a side view of the entire paint brush.

Turning now descriptively to the drawings, FIG. 1 illustrates the paint brush 10 in its entirety. In one embodiment, the brush comprises a wooden, polymer or composite handle 20, a bristles 40, and a magnetic attachment 30 placed in a notched section of the wooden handle 20. The handle features a flanged flat surface, or hilt, at the base of the handle. The bristles can be made of or manufactured from either synthetic or manmade materials. A metal band 15 is attached to the brush 10 with brads or small nails, and protects and secures the bristles to the brush 10.

Figure 2:
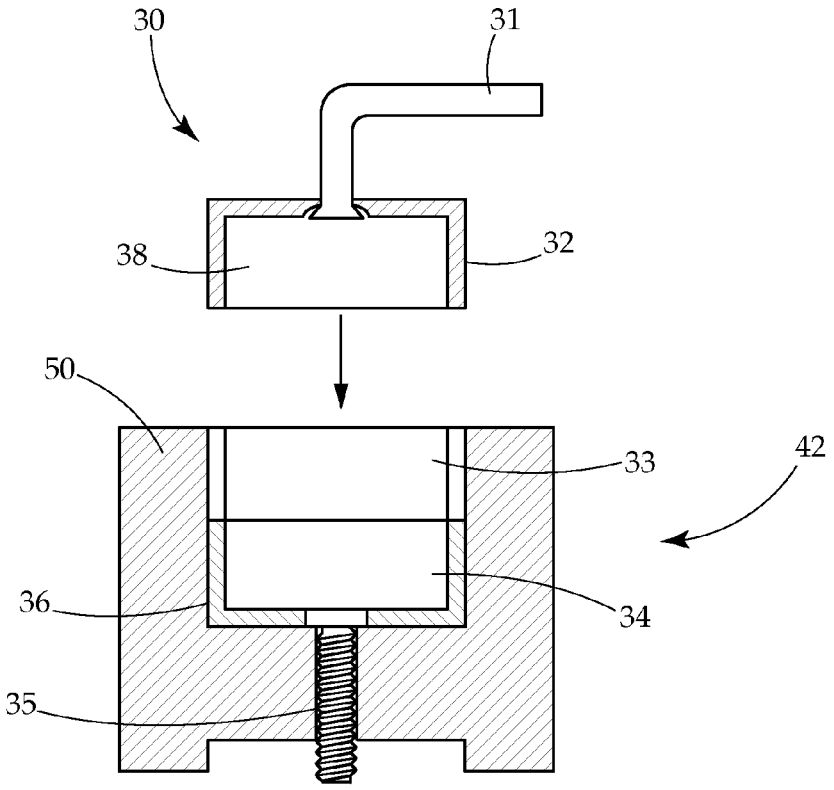
FIG. 2 shows a top cut away view of the brush handle, emphasizing the attachable magnetic hook.

In one embodiment of the instant system 10, the main feature is the magnetic hook attachment 30 and magnetic assembly system 42, which is further depicted in FIG. 2. In this embodiment, the magnetic assembly system 42 comprises two magnets 33, 34 sit within a notch 51 routed into the wooden handle 20. Thus, these magnets 33, 34 allow the hook attachment 30 to hold and withstand the weight of the brush when hanging.

Figure 3:
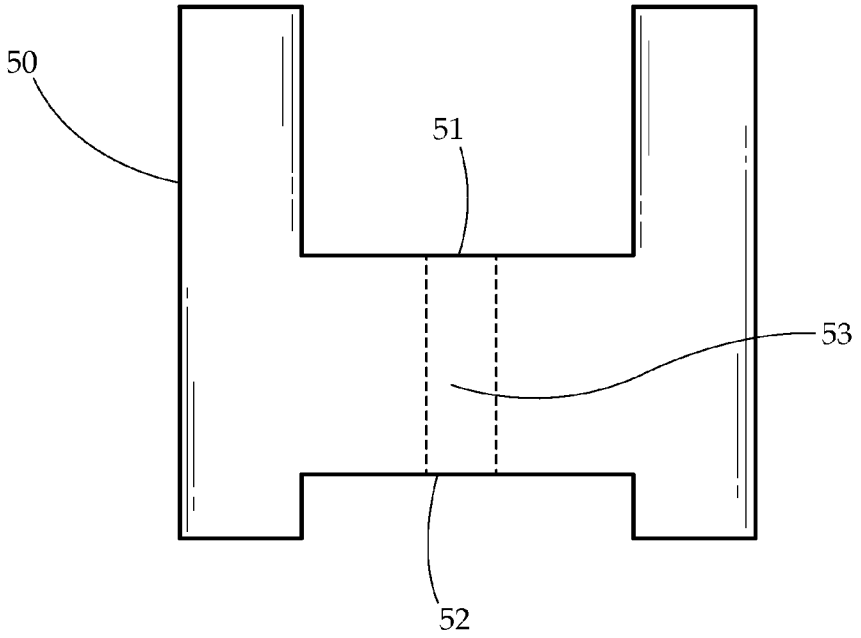
FIG. 3 shows another top cut away view of the brush handle, depicting the entire cross section.

FIGS. 2 and 3 illustrate a cross section 50 of the wooden handle 20, showing the magnetic hook attachment 30 and the magnetic assembly system 42. In this embodiment, the magnetic assembly system may include two magnets 33 34. One magnet 34 sits within a hollowed interior cap 36, and is preferably flush with the rim of the interior cap 36. The hollowed interior cap 36 is permanently adhered to the interior of the brush handle by the use of a bolt 35, which screws through the remaining solid piece of the handle cross section 50 and is secured in place by a nut 37 in the opposing notched section 52 (see FIG. 4). The other magnet 33 then sits on top of the first magnet 34, leaving a space between the magnet 33 and the notch 51.

Figure 5:
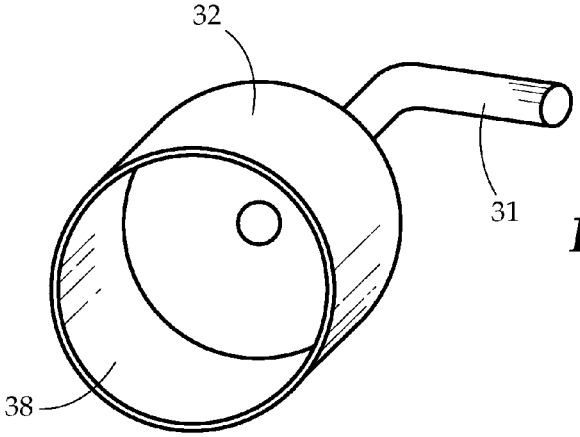
FIG. 5 shows a top cut away view of the brush handle in an alternative design, depicting the entirely hollow section of the brush with magnet attaching to each end.

Referring to FIGS. 2 and 5, the magnetic hook attachment 30 comprises an exterior cap 32 with a hollowed or counter sunk area 38, or belly 38 and hook 31. The exterior cap 32 is then over the assembled magnetic assembly system 42. The exterior cap 32 is attracted to the magnetic force of the magnet 33, which then encompasses the magnet 33 within the hollowed belly 38, creating a highly secure connection, yet one that is easily removed by pulling the magnetic hook attachment 30 laterally away from the center of the brush. When assembled and flush, only the hook 31 is left extended to catch a lip or rim of various items to be hung during use or for storage. In some embodiments, the second magnet 34 may be attached to the hook attachment 30 and be situated within the hollowed belly 38. In some embodiments, the magnets 33 34 may be of different sizes. Preferably, the magnets 33 34 should be sufficiently strong so as to easily prevent their separation. In some embodiments, the magnets 33 34 may comprise only a single magnet.

FIG. 3 highlights the entire cross section 50 of the wooden handle 20 where the magnetic hook attaches. The handle features two notches 51, 52. These notches directly oppose each other. The larger notch 51 is where the magnetic hook attachment 30 attaches, whereas the smaller notch 52 houses the nut 37 that holds the bolt 35 in place. The bolt 35 is drilled through the entirety of the cross section 50, thus creating a channel 53 and connecting the two notches 51, 52. In some embodiments, the channel 53 may be drilled prior to the introduction of the bolt 37. The notches 51, 52 are preferably routed to a sufficient depth such that the interior cap 36 and nut 37 are flush with the surface of the handle 20. Further, the notches 51, 52 are preferably sized so as to snugly accommodate the interior cap 36 and nut 37.

Figure 4:
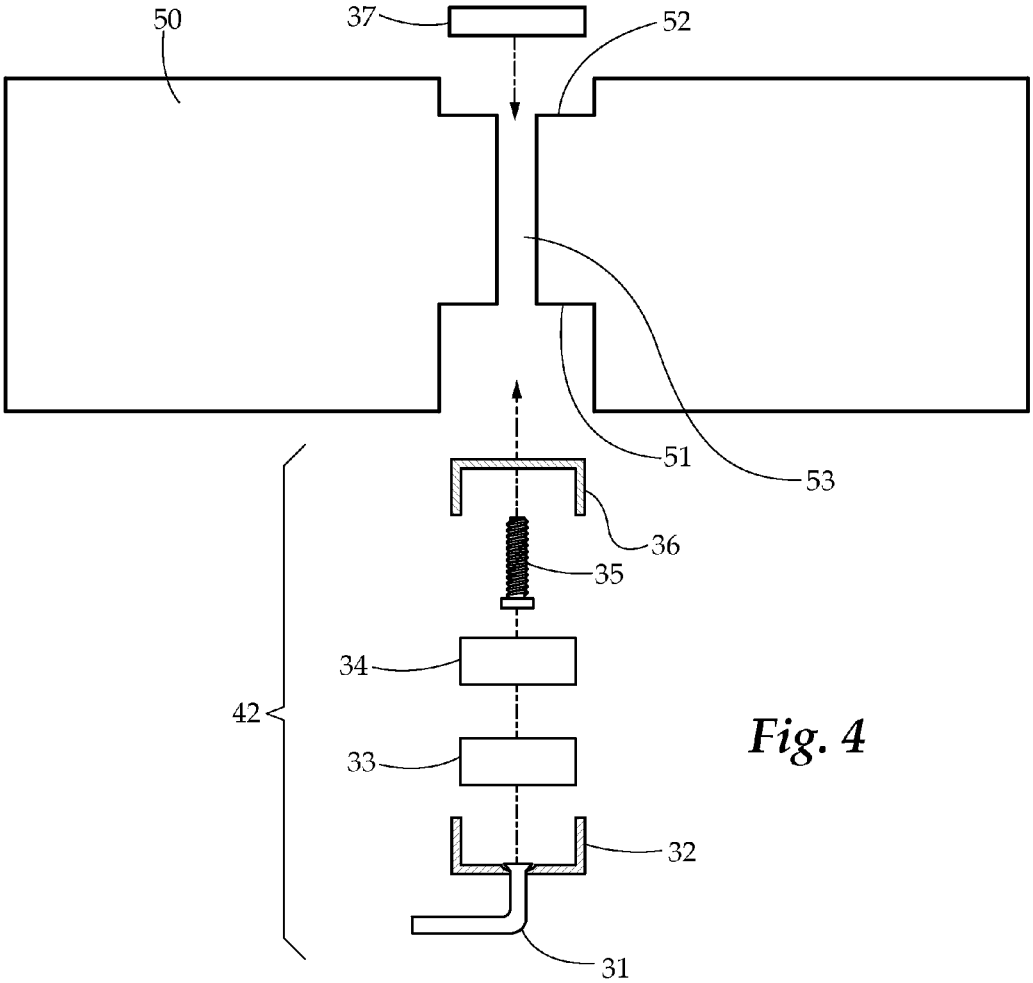
FIG. 4 shows another top cut away view of the brush handle, depicting the entire cross section and including the numerous elements in their correct order that comprise the magnetic hook attachment.

FIG. 4 illustrates an exploded view comprising the overall assembly of the magnetic hook assembly system 42. At the top of the figure is a cross section 50 of the handle 20, comprising the two notches 51 52. The interior cap 36 fits within the larger notched section 51 and is secured by a bolt 35 that will screw through the interior cap 36, through the channel 53, and into the nut 37 fitting within the smaller notched section 51. The first and second magnets 33 34 fit within the interior cap 36. Finally, the magnetic hook attachment 30 comprising the hook 31 and exterior cap 32 fits over the magnetic hook assembly 42 within the notch 51.

In no manner to the limit the system herein, the system may be revealed in at least three embodiments deemed the Magnabrush™ I (one), Magnabrush™ II (two), and Magnabrush™ III (three). The Magnabrush™ I may comprise a countersunk aperture or hole in the surface of the face of the paintbrush located at center and just above the metal band or bristle guard where the cap/cover and hook attaches to the magnet on the surface or face of the paintbrush.

This aperture may comprise substantially the diameter of the cap or cover placed face first into the hole in the brush where a threaded bolt is inserted through the hole in the cap and out through to the other side of the paintbrush. One magnet is inserted into the cap where it lies flush within the cap itself and the second magnet is inserted into the hole in the paintbrush where it will come to rest directly over the first magnet this second magnet sits so firmly on top of the first magnet that they are now virtually one magnet. Due to the dual nature of these magnets and thus the increased field strength provided, once the magnets are aligned juxtaposition, no shift of the magnets will occur what so ever.

This second magnet once attached to the first magnet that is situated within the cap itself does not fill up the entire hole within the brush handle as the magnet within the cap/cup does. This has the effect of leaving a perfect channel or space encircling the second or upper magnet closest to the surface of the paintbrush. The absence of the thickness of the cap or cup that encompasses the first magnet that has filled the void within the cap itself is the reason for the space around the second cap.

This allows for the cap or cup with the hook in it to fit snugly over and around the second magnet with the channel or space around it once the cap/cup and hook is seated within the slot around the magnet. The magnet then pulls the cap and hook firmly to it. This action now has the effect of tightening up the movement of the free moving or swiveling hook to the point where the hook moves with just a gentle touch of the finger away from the finger, which eliminates the hook digging into the finger during normal use of the paintbrush.

The Magnabrush™ II is structured almost identically to the Magnabrush™ I in almost every detail except for two unique changes to the outer surface of the paintbrush as well as minor alterations to the wood handle and the positioning of the two magnets and the two predrilled caps. Unlike the original Magnabrush™ I, the Magnabrush™ II and it's magnet and hook assembly hook system incorporates a magnet within the cap and hook itself as opposed to the magnet inserted within the face of the paintbrush in the original Magnabrush™ I. The cap and magnet that is placed within the face of the Magnabrush™ I, followed by the second magnet placed directly on top of the first magnet within the hole which is intern within the paintbrush, then the cap with the hook in it is placed on or over the magnet that sits flush within the face of the paintbrush.

Further, the magnet, cap/cup and hook system that is incorporated within the Magnabrush™ I, has been altered in a way so as to allow for one of the two magnets to be placed in a way so as to allow for one of the two magnets to be placed on the opposite side of the paintbrush thereby allowing for the paintbrush to be attached (magnetically) to any metallic surface. Thus, there are two magnets with the cap and hook located on one side of the Magnabrush™ I.

Furthermore, the Magnabrush™ II, has taken one of the two magnets and split them leaving one magnet on the side of the brush where the cap and hook attaches to the paintbrush where one of the magnets has been removed the routed hole in the face of the Magnabrush™ I, has now been reduced to almost half the depth of the hole of the Magnabrush™ I. Thus, the washer that is located on the backside of the Magnabrush™ I has been moved to where the aperture or hole (half the depth) of the paintbrush where the cap/cup and hook on the Magnabrush™ II is to be attached.

And the cap and hook on the Magnabrush™ II now fits into a vacant hole within the face of the paintbrush where the two magnets used to be and where the cap and hook would slip over and onto the magnet closest to the surface or face of the paintbrush. Now that both magnets have been removed from within the Magnabrush™ I paintbrush on the side where the cap and hook is attached and the hole in the side or face of the paintbrush has been reduced to half the depth of that of the hole in the Magnabrush™ I.

Additionally, the washer that was flush on the surface or face of the opposite side of the paintbrush has now been transferred to the side of the paintbrush where the cap and hook would attach to the two magnets that have been removed and replaced with a washer seated within the hole of the paintbrush is now used not only to tie both ends of the bolt that holds both parts of the magnetic assembly system at either side of the paintbrush together but it is also the metal surface that the magnetic cap/cup and hook system attaches.

The cap and hook of the Magnabrush™ I has thus been magnetized by taking one of the two magnets taken from the Magnabrush™ I and placing it within the cap of the cap and hook itself, the hollow cap has now been filled with a magnet that sits within the hollow cap flush the rim of the cap. The magnet within the cap is now into the holes until it comes to sit directly against the metal washer within the face the paintbrush. The cap and hook is now firmly attached to the washer within the face of the paintbrush.

Therefore, when the cap and hook is removed from the surface of the paintbrush there is a cavity within the face of the Magnabrush II where the cap and hook with the magnet placed within the cap itself is inserted into the cavity, thereby connecting itself to the washer within the cavity of the Magnabrush II which is in direct contrast from the Original Magnabrush where the hollow cap and hook are placed over a magnet that sits flush within the surface of the paintbrush itself.

The other of the two magnets that is located on the hook side face of the Magnabrush™ I has thus been relocated to the side or face of the paintbrush where on the Magnabrush™ II and where the washer used to be, now in place of the washer that once sat flush on the backside of the Magnabrush™ I, a hole or aperture has been routed to the depth of one of the caps/cups. The cap is placed head first into the cavity of the brush where it is attached to the opposing side.

Moreover, after inserting and connecting the cap within the cavity of the paintbrush a magnet is inserted within the cavity of the cap which has been placed within the face of the paintbrushes hollow end facing out and away from the surface of the paintbrush. Ergo, where the Magnabrush™ I has a cap and hook, that has to be removed to allow the paintbrush to be magnetically attached to any metal surface the Magnabrush™ II, which is basically a redesigned Magnabrush™ I.

Figure 6C:
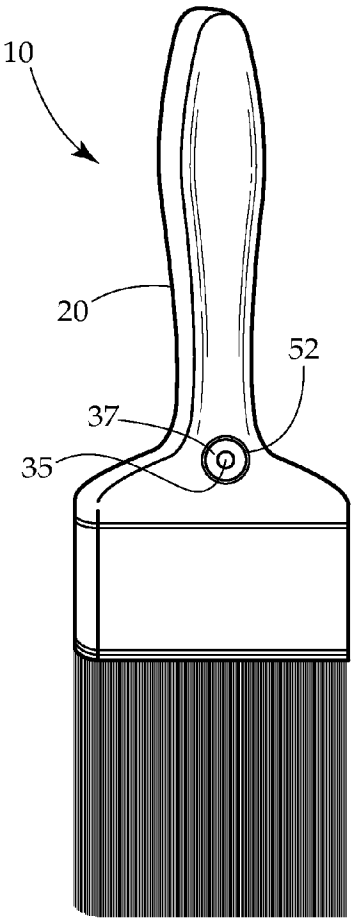
FIGS. 6A-6C illustrate a series views of an assembled embodiment.
Figure 6B:
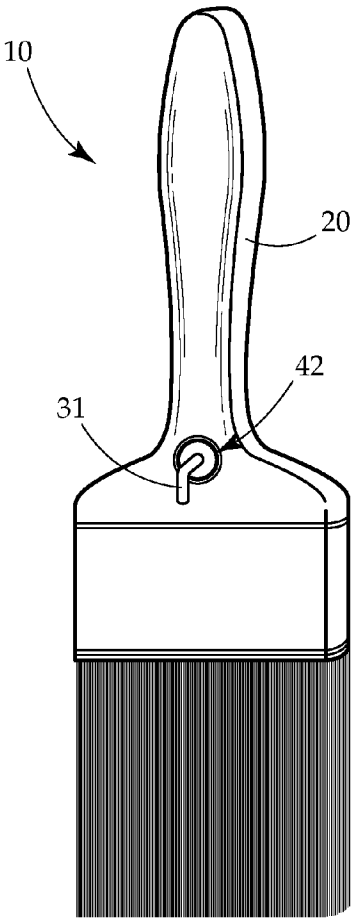
Figure 6A:
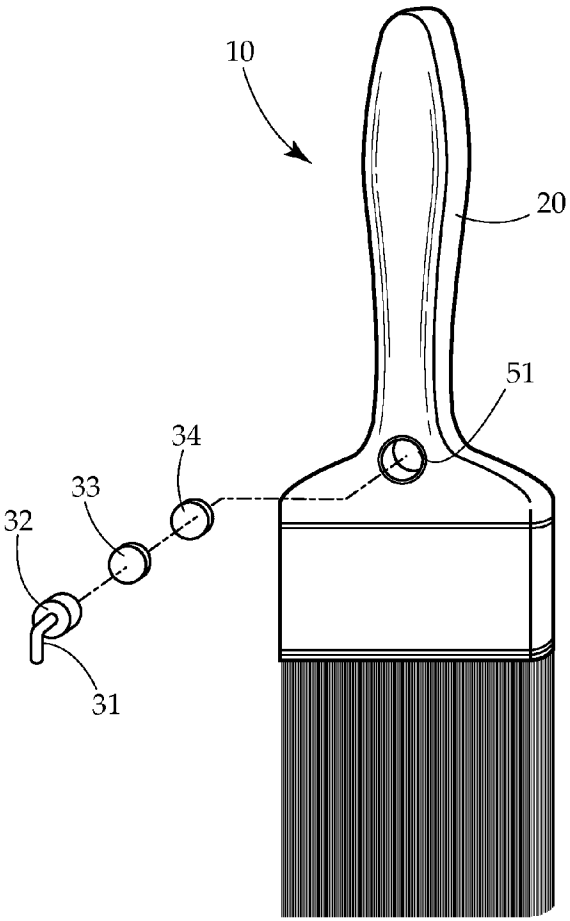

FIGS. 6A-6C are different views illustrating a fully assembled embodiment of the instant system. The brush 10 contains two notches 51 52 on the front and back of the handle 20. On the front of the handle 20, two magnets 33 34 sit within a hollowed-out interior cap 36, which itself is situated within the notch 51. On the rear of the handle 20, the nut 37 and bolt 35 are visible, sitting within the notch 52 and flush with the handle's surface. The magnetic hook attachment 30, comprising a hook 31 and exterior cap 32, can then be placed over the magnets 33 34, thus magnetically attaching the hook attachment 30 to the magnetic assembly system 42.

Figure 7A:
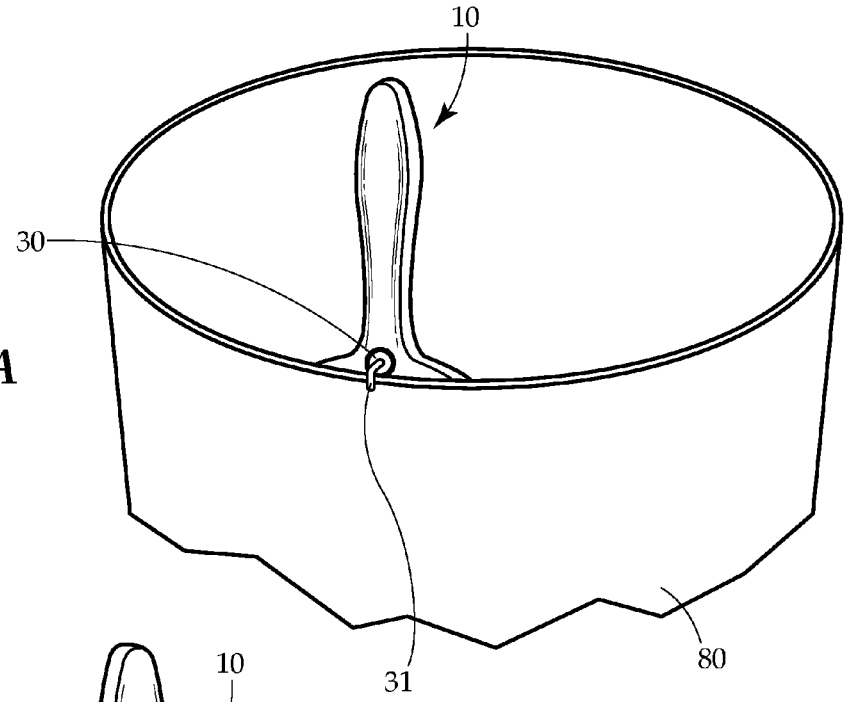
FIGS. 7A-7B illustrate a series views of an assembled embodiment in use with a paint bucket.
Figure 7B:
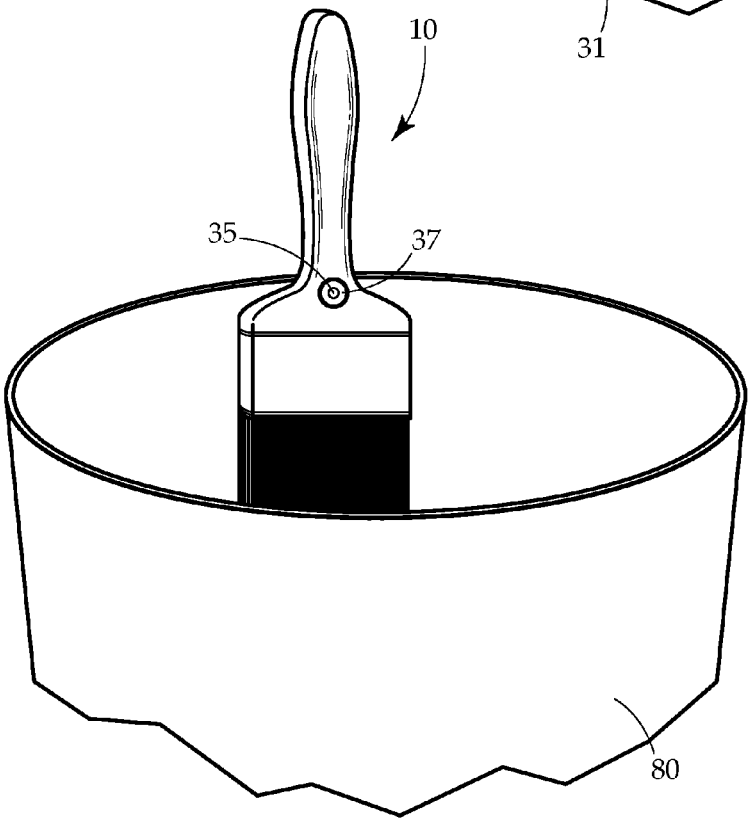

FIGS. 7A-7B are additional views of the use of the magnetic brush 10. Once the magnetic hook attachment is affixed to the brush 10, the brush can be placed on the rim of a bucket/paint pail 80. The brush 10 can easily be lifted out of the bucket and placed back such that it hangs on the rim. As opposed to previous systems employing a nail hammered into the handle, the present embodiment and system will not often result in split handles. Further, as the magnetic portion is used to secure the hook attachment 30 to the brush 10, the brush will not become magnetically attached to the bucket 80 itself. The secure connection between the magnets 33 34 and the hook attachment 31 allows for the paintbrush to be effortlessly slipped onto the rim of the paint pail, and just as simply and effortlessly removed from the rim of the paint pail. There is no swinging of the brush within the pail, and mishaps are less likely. Further, the effort required to remove the magnetic hook attachment 30 is much greater than the effort required to merely lift the paint brush off of the bucket, highly reducing the chances of the separation of the hook attachment and subsequent drop of the brush into the paint.

This result creates a variety of benefits. The paint brush 10 is better secured, and is less likely to be dropped. The magnetic hook attachment 30 is easily removed and reattached. Additionally, in the past, the only way to avoid submerging a brush in paint was to fill the paint pail or bucket with only a small amount of paint. With the present embodiment, the brush hangs from the rim of the bucket, allowing for significantly more paint to be stored in the pail. A painter working on a ladder would have to refill the bucket less often, thus increasing safety by reducing the number of trips up and down the ladder. Further, both the brush and the paint remain cleaner and free of contamination, as the painter will be less inclined to place or rest the brush on other exterior surfaces.

Figure 8:
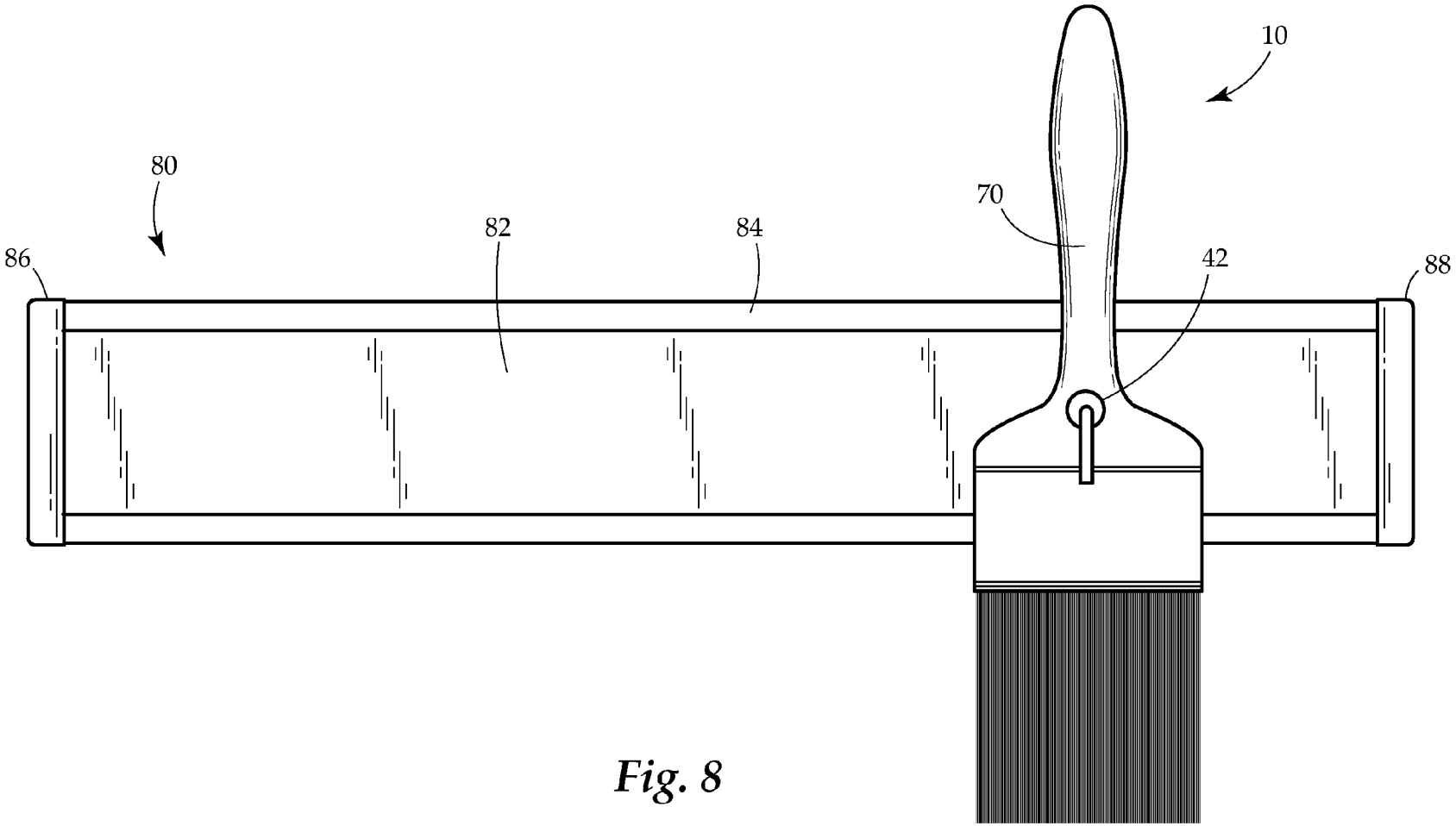
FIG. 8 is a plan view of an assembled embodiment in use with another hanging source.

FIG. 8 illustrates another beneficial use of a brush 10 that has incorporated a magnetic hook assembly system 42. In addition to holding a brush against the rim of a paint can, one can store paint brushes on a wall using a magnetic paint brush storage system 80. In this embodiment, the magnetic paint brush storage system comprises a metal plate 82 is attached to a backing 84. The ends of the metal plate are covered by end caps 86 so that any sharp edges are contained. The backing can be made of plastic, fiber, or any other suitable material.

The magnetic paint brush storage system 80 is then secured to a wall or other surface. A paint brush utilizing the magnetic assembly system 42 will then magnetically attach to the magnetic paint brush storage system 80, without the need for any hooks, straps, or hanging bars.

Figure 10:
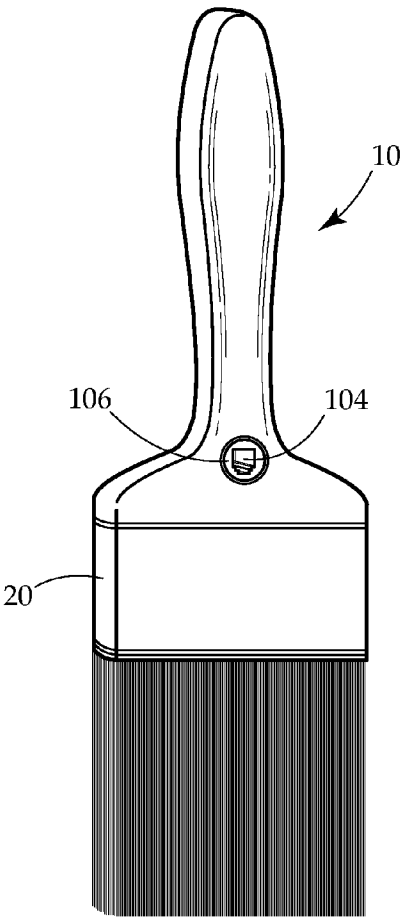
FIG. 10 is a front view of an embodiment of the instant system.
Figure 9:
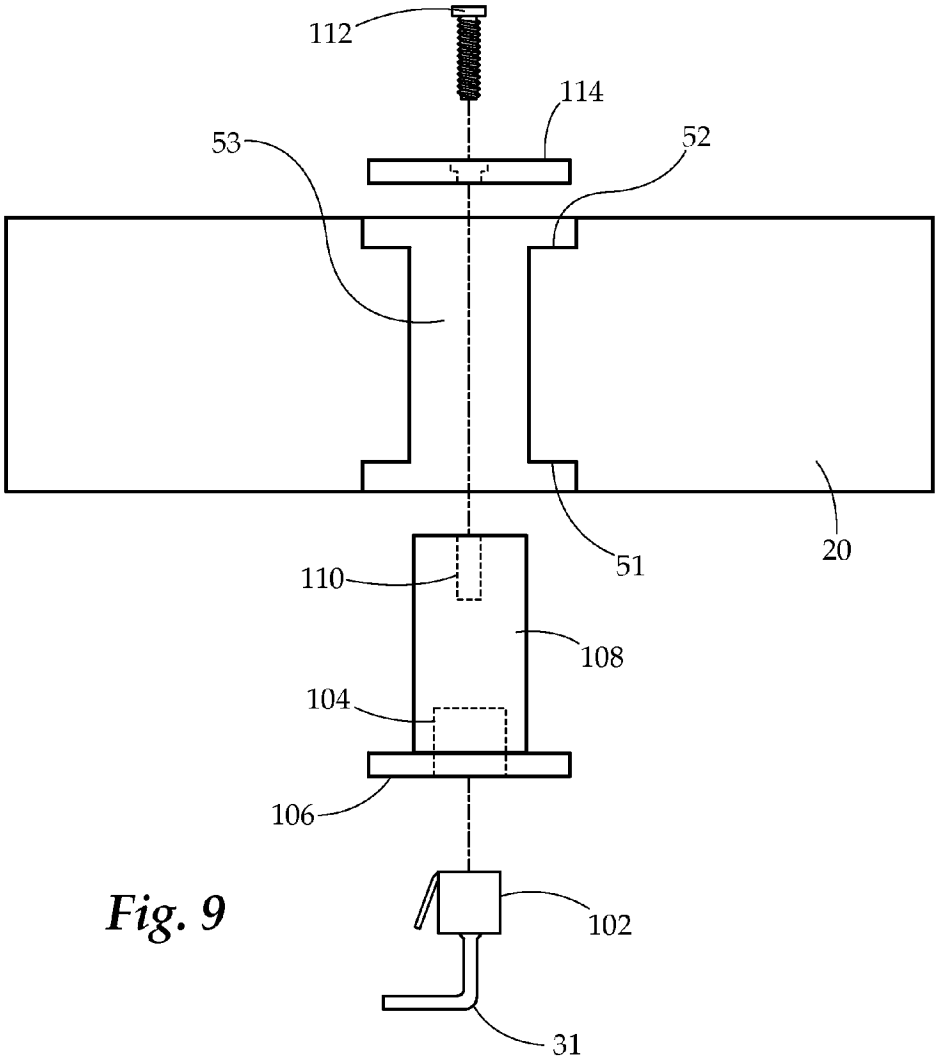
FIG. 9 is an exploded view of an embodiment of the instant system.

FIGS. 9 and 10 illustrate another embodiment of the present system, which can also be clip mechanism comprises a male jack plug 102 (such as an RJ-11 telephone jack) attached to a hook 31, and a female jack plug 104. A washer 106 is attached to the receiving end of the female jack plug 104, and a tubular post 108 is attached to the back end. The tubular post 108 has a threaded portion 110 that can receive a bolt 112. The embodiment is assembled by placing the combination of the tubular post 108, female jack plug 104, and washer 106 within the channel 53 such that the washer 106 fits within the notch 51. The bolt 112 is then inserted through another washer 114 and into the threaded portion 110 of the tubular post 108. Once the bolt 108 is tightened, preferably both washers 106 114 are flush with the face of the wooden handle 20. Next, the male jack plug 102 can be inserted into and easily removed from the female jack plug 104. Thus, this embodiment of the present system allows for the hook to be removably attached from the handle 20.

In alternative embodiments, the handle may feature a specially shaped notch. An attachment head, similar to the hook attachment 30, would also be specially shaped, and thus capable of attaching to the notch using an arm. A hook piece is housed inside the special attachment head.

In alternate embodiments, the cross section of the brush handle 50 may feature an entirely hollowed section. In this embodiment, a screw, washer, and a second cap would hold the first magnet 33 to the second magnet 34. The screw would go through the washer and into the second cap. The two caps are of equal size and house the magnets 33 34 also of equal size, entirely. The center section comprises of the washer and the screw. When all of the elements sit within the hollowed section, the magnets 33 34 sit flush to the exterior of the handle and only the hook attachment 30 protrudes.

Regarding individual aspects of the system, ferrule shape varies with the brush style. Ferrules may be rectangular with square or rounded ends, oval or round shape. Ferrules may be made from copper, stainless, and tin-plated steel and since most brushes will come in contact with water during painting or cleaning, the ferrule material should be resistant to rust. Rust from the ferrule or nails in a used brush will bleed into the paint and cause discolored streaks. The brush head can be attached to the handle by crimping, stapling, or nailing the ferrule to the handle. The most durable assembly uses ring nails that connect the ferrule, a ferrule insert, and the handle together.

On thinner handles, nails or other affixing mechanisms should be offset or staggered in a pattern that prevents nails from the two sides being directly opposite each other to minimize the chance of splitting the wood or plastic. Poor filament retention in the ferrule can cause a brush to shed filaments. Thus, the loose filaments are often deposited on the painted surface or left in the paint can. When examining a brush, see if the filaments come loose when pulled gently by hand. Securing the filament in the brush head depends on such factors as epoxy type, mixture accuracy, filament shape, and polymer type. A metal ferrule insert placed against the base of the filaments helps to keep the filament securely in the ferrule. The purpose of the insert is to mold and distribute the epoxy compound through the holes in the insert. The insert also provides a strong surface for later nailing the brush head to the handle. Thus, although brushes may appear to be simplistic tools, many factors must be considered when manufacturing and choosing a brush for certain utilities.

Addressing the instant apparatuses and matter surrounding said apparatuses, in one embodiment, the apparatus herein may include a combined brush and storage mechanism comprising a body mechanism which includes a handle, a brush head, a brush ferrule, a metal insert and a set of tapered plugs. The apparatus may further comprise a receiving mechanism located in the brush head between the handle and the ferrule, and a set of filaments wherein the set of filaments are inserted into the tapered plugs and retained by the metal insert and the tapered plugs. The instant embodiment may also comprise a retaining mechanism which attaches to the receiving apparatus and may encompass a proximal end and a distal end and may comprises a hook mechanism disposed on the distal end and a clip mechanism attached to the proximal end for attaching the retaining mechanism to the receiving mechanism located in the brush head. The present system can also be easily stored. Referring to FIG. X, the magnetic.

In an additional embodiment, the clip mechanism may also comprise a male jack plug and the receiving mechanism may comprise a female jack plug. Additionally, the combined brush and storage mechanism may include a retaining mechanism which may comprise a hook mechanism. Furthermore, the receiving mechanism may comprise at least one magnetic element or may even comprise two or more juxtaposition magnetic elements. Thus, in order to match up for mating purposes, the retaining mechanism may also comprise a magnetic element attached to the proximal end. To further assist in housing the magnetic members the receiving mechanism may also comprise a shallow cylindrical aperture or a cylindrical aperture disposed through the entirety of the head.

In an additional embodiment, the receiving mechanism may also comprise a cylindrical aperture comprising a hollowed inside cap mechanism, a bolt mechanism and an exterior cap mechanism, and a nut mechanism, wherein the hollowed inside cap is permanently adhered to the interior of the cylindrical aperture by the bolt; and wherein the bolt is disposed to pass through the entirety of a solid portion of the handle cross section wherein the nut mechanism is in slidable communication with the bolt mechanism.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination.

Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system variants and components in the embodiments described above should not be understood as requiring such separation in all embodiments, and it should be understood that the described components and systems can generally be integrated together in a single software product or packaged into multiple software products.

Particular embodiments of the subject matter have been described. Other embodiments are within the scope of the invention. For example, the actions recited in the description can be performed in a different order and still achieve desirable results.

What I claim is:

1. A combined brush and storage mechanism comprising:
a body mechanism comprising:
a handle;
a brush head;
a brush ferrule;
a metal insert; and
a retaining mechanism comprising a proximal end and a distal end wherein the proximal end comprises a mating mechanism;
a receiving mechanism located in the brush head between the handle and the ferrule, attached to the retaining mechanism by the mating mechanism; wherein the receiving mechanism further comprises a cylindrical aperture comprising:
a hollowed inside cap mechanism;
a bolt mechanism;
an exterior cap mechanism; and,
a nut mechanism; wherein the hollowed inside cap is permanently adhered to the interior of the cylindrical aperture by the bolt; and wherein the bolt is disposed to pass through the entirety of a solid portion of the handle cross section wherein the nut mechanism is in slidable communication with the bolt mechanism and wherein the retaining mechanism comprises a proximal end and a distal end wherein the proximal end comprises a mating mechanism attached to the receiving mechanism; and,
a set of bristles retained by the metal insert.

2. The combined brush and storage mechanism of claim 1 wherein the receiving mechanism comprises at least one magnetic member and the mating mechanism comprises a magnetic member.

3. The combined brush and storage mechanism of claim 2 wherein the at least one magnetic member comprises two juxtaposition magnetic members.

4. The combined brush and storage mechanism of claim 1 wherein the receiving mechanism comprises a female phone jack member and the mating mechanism comprises a male phone jack member.

5. The combined brush and storage mechanism of claim 1 wherein the retaining mechanism comprises a magnetic mechanism disposed on the distal end for retaining the combined brush and storage mechanism.

6. The combined brush and storage mechanism of claim 1 wherein the retaining mechanism comprises a loop and hook mechanism disposed on the distal end for retaining the combined brush and storage mechanism.

7. The combined brush and storage mechanism of claim 1 wherein the retaining mechanism comprises a hook mechanism disposed on the distal end for retaining the combined brush and storage mechanism.

8. The combined brush and storage mechanism of claim 7 wherein the hook mechanism may be selected from the group consisting of L-shaped hook, a C-shaped hook, a banana clip, and a carabiner clip.

9. The combined brush and storage mechanism of claim 8 wherein the hook mechanism is rotatable.

10. The combined brush and storage mechanism of claim 1 wherein the receiving mechanism comprises a substantially cylindrical aperture.

11. The combined brush and storage mechanism of claim 10 wherein the substantially cylindrical aperture is disposed through the entirety of the head.

12. A fluid application mechanism comprising:
a body mechanism comprising:
a handle;
a brush head;
a brush ferrule;
a metal insert; and
a receiving mechanism located in the brush head between the handle and the ferrule; wherein the receiving mechanism comprises a cylindrical aperture comprising:
a hollowed inside cap mechanism;
a bolt mechanism; and,
an exterior cap mechanism;
a nut mechanism; wherein the hollowed inside cap is permanently adhered to the interior of the cylindrical aperture by the bolt; and wherein the bolt is disposed to pass through the entirety of a solid portion of the handle cross section wherein the nut mechanism is in slidable communication with the bolt mechanism and wherein a retaining mechanism comprises a proximal end and a distal end wherein the proximal end comprises a mating mechanism attached to the receiving mechanism; and,
a set of bristles retained by the metal insert.

13. The fluid application mechanism of claim 12 wherein the exterior cap comprises a hollowed area attached to and surrounding the receiving mechanism.

14. The fluid application mechanism of claim 12 wherein the receiving mechanism is a first magnetic member.

15. The fluid application mechanism of claim 12 wherein the handle comprises a first notch and a second notch wherein the first notch and the second notch directly oppose each other.

16. The fluid application mechanism of claim 15 wherein the handle comprises a first notch is larger than the second notch and wherein the retaining mechanism attaches to the first notch and the second notch houses the nut mechanism.

17. The fluid application mechanism of claim 15 wherein the retaining mechanism is a magnetic hook.

* * * * *